US009589505B2

(12) United States Patent
Zhang

(10) Patent No.: US 9,589,505 B2
(45) Date of Patent: Mar. 7, 2017

(54) OLED PIXEL CIRCUIT, DRIVING METHOD OF THE SAME, AND DISPLAY DEVICE

(71) Applicants: BOE TECHNOLOGY GROUP CO., LTD., Beijing (CN); HEFEI XINSHENG OPTOELECTRONICS TECHNOLOGY CO., LTD., Anhui (CN)

(72) Inventor: Yuting Zhang, Beijing (CN)

(73) Assignees: BOE TECHNOLOGY GROUP CO., LTD., Beijing (CN); HEFEI XINSHENG OPTOELECTRONICS TECHNOLOGY, CO., LTD., Hefei, Anhui (CN)

( * ) Notice: Subject to any disclaimer, the term of this patent is extended or adjusted under 35 U.S.C. 154(b) by 73 days.

(21) Appl. No.: 14/422,377

(22) PCT Filed: Jun. 30, 2014

(86) PCT No.: PCT/CN2014/081188
§ 371 (c)(1),
(2) Date: Feb. 19, 2015

(87) PCT Pub. No.: WO2015/062298
PCT Pub. Date: May 7, 2015

(65) Prior Publication Data

US 2016/0005356 A1 Jan. 7, 2016

(30) Foreign Application Priority Data

Nov. 4, 2013 (CN) ..... 2013 1 0538421

(51) Int. Cl.
*G09G 3/3233* (2016.01)
*G09G 3/32* (2016.01)

(52) U.S. Cl.
CPC ... *G09G 3/3233* (2013.01); *G09G 2300/0819* (2013.01); *G09G 2300/0852* (2013.01);
(Continued)

(58) Field of Classification Search
CPC ..... G09G 3/3233; G09G 3/3258; G09G 2300/842; G09G 2320/045
See application file for complete search history.

(56) References Cited

U.S. PATENT DOCUMENTS

2003/0227262 A1 12/2003 Kwon
2006/0157710 A1 7/2006 Lee et al.
(Continued)

FOREIGN PATENT DOCUMENTS

CN 1855198 A 11/2006
CN 101996579 A 3/2011
(Continued)

OTHER PUBLICATIONS

Chinese Office Action dated Feb. 17, 2015 issued in corresponding Chinese Application No. 201310538421.5 along with English translation.

(Continued)

*Primary Examiner* — Ricardo L Osorio
(74) *Attorney, Agent, or Firm* — Nath, Goldberg & Meyer; Joshua B. Goldberg; Christopher Thomas

(57) ABSTRACT

An OLED pixel circuit includes a data strobe module, a threshold compensation module, a driving module, and a light-emitting module. Wherein, the data strobe module is used for inputting a data signal on a data signal line to the driving module under control of a scanning signal of a scanning signal line; the threshold compensation module is used for compensating a threshold voltage of the driving module; and the driving module is used for driving the light-emitting module to emit light according to the data
(Continued)

signal provided by the data strobe module. The OLED pixel circuit can compensate shift and inconsistency of a threshold voltage of a transistor therein effectively, so that the drive current of the OLED will not affected by the threshold voltage of the transistor, making brightness of a display device more uniform.

16 Claims, 3 Drawing Sheets

(52) U.S. Cl.
CPC . *G09G 2310/0251* (2013.01); *G09G 2310/08* (2013.01); *G09G 2320/045* (2013.01); *G09G 2320/0626* (2013.01)

(56) References Cited

U.S. PATENT DOCUMENTS

2006/0244688 A1 11/2006 Ahn et al.
2009/0096721 A1 4/2009 Chiou et al.
2015/0002414 A1* 1/2015 Tan ..... G06F 3/044 345/173
2015/0302801 A1* 10/2015 Tan ..... G06F 3/042 345/173
2016/0005356 A1* 1/2016 Zhang ..... G09G 3/3233 345/690
2016/0071458 A1* 3/2016 Tan ..... G09G 3/3233 345/212

FOREIGN PATENT DOCUMENTS

CN 102651194 A 8/2012
CN 102651196 A 8/2012
CN 103208254 A 7/2013
CN 203165421 U 8/2013
CN 103345901 A 10/2013
CN 103354079 A 10/2013
CN 103531151 A 1/2014
TW 1312497 B 1/2005

OTHER PUBLICATIONS

International Search Report dated Jun. 30, 2014 corresponding to application No. PCT/CN2014/081188.

* cited by examiner

OLED PIXEL CIRCUIT, DRIVING METHOD OF THE SAME, AND DISPLAY DEVICE

This is a National Phase Application filed under 35 U.S.C. 371 as a national stage of PCT/CN2014/081188, filed Jun. 30, 2014, an application claiming the benefit of Chinese Application No. 201310538421.5, filed Nov. 4, 2013, the content of each of which is hereby incorporated by reference in its entirety.

FIELD OF THE INVENTION

The present invention relates to the field of display technology, in particular, relates to an OLED pixel circuit, a driving method of the same, and a display device.

BACKGROUND OF THE INVENTION

An OLED (organic light-emitting diode) is a newly developed flat panel display device, and has a broad application prospect due to that it has advantages such as self-luminescence, high contrast, wide color gamut, simple manufacturing process, low cost, low power consumption, being easy to implement flexible display, ant the like.

An OLED pixel circuit in an organic electroluminescent display device is generally arranged in a matrix. OLED pixel circuits can be classified into two types of passive matrix organic light emission display (PMOLED) pixel circuit and active matrix organic light emission display (AMOLED) pixel circuit according to drive modes thereof. Although the PMOLED has advantages such as simple process and low cost, it cannot meet the requirements of high-resolution large-size display due to disadvantages such as crosstalk, high power consumption, short service life, and the like. In contrast, in the AMOLED, each pixel circuit is integrated with a set of thin film transistors (TFTs) and a storing capacitor (simply referred to as $C_S$) therein, and an electric current flowing through the OLED is controlled by controlling the drive on the thin film transistors TFT and the storing capacitor $C_S$ to make the OLED luminous. As compared with the PMOLED, the AMOLED can meet the requirements of large-size display with a high resolution and multiple grayscales due to its small drive current, low power consumption, and long service life. Further, the AMOLED has obvious advantages in terms of viewable angle, color restoration, power consumption, response time, and the like, and is applicable to a display device with high information content and a high resolution.

FIG. 1 is a schematic diagram showing the structure of an AMOLED pixel circuit of 4T1C (four transistors and one capacitor) type in the prior art, wherein an electric current flowing though the OLED is as follows:

$$I_{OLED}=I_{T1}=k(V_{DATA}-N_{TH})^2 \quad (1)$$

In the Equation (1), k is a constant relevant to the structure of T1, $V_{DATA}$ is a data voltage, and $V_{TH}$ is a threshold voltage of the T1.

Since the OLED is a device driven by an electric current, from the Equation (1), it can be seen that the electric current flowing through the OLED is not only controlled by the data voltage $V_{DATA}$, but also influenced by the threshold voltage $V_{TH}$ of TFT. Thus, the structure of the OLED pixel circuit as shown in FIG. 1 cannot compensate drift and inconsistency of the threshold voltage of the TFT, and thus threshold characteristics of the TFT affect a drive current greatly. Further, during manufacture of an array substrate, since the manufacturing process of an oxide TFT is not mature enough, characteristics of the oxide TFT, such as threshold voltage and mobility, varies greatly in different regions, and thus TFTs in various OLED pixel circuits cannot have completely consistent performance parameters. At the same time, as time goes on, a threshold of each TFT will shift and a drive current of each TFT will change due to the presence of a voltage stress, resulting in that electric currents flowing through OLEDs in various OLED pixel circuits are inconsistent. Thus, brightness of light emitted by various OLED pixel circuits is nonuniform, which affects the brightness of the final display greatly. Therefore, the brightness of the whole display screen is nonuniform, which affects the display effect.

SUMMARY OF THE INVENTION

The present invention is made to slove the above problems in the prior art. In view of the problems, the present invention provides an OLED pixel circuit, a driving method of the same, and a display device. The OLED pixel circuit can compensate shift and inconsistency of a threshold voltage effectively, so that uniformity of brightness of light emitted by various OLED pixel circuits is ensured, thereby increasing a display quality.

A technical solution employed to solve the technical problems is an OLED pixel circuit including a data strobe module, a threshold compensation module, a driving module, and a light-emitting module, wherein the data strobe module is connected to the driving module, a scanning signal line, and a data signal line, respectively, and is used for inputting a data signal on the data signal line to the driving module under control of a scanning signal of the scanning signal line;

the threshold compensation module is connected to the data strobe module, a first control signal line, a second control signal line, a first voltage terminal, and the driving module, respectively, and is used for compensating a threshold voltage of the driving module according to control signals of the first control signal line and the second control signal line; and the driving module is further connected to the light-emitting module, and is used for driving the light-emitting module to emit light according to the data signal provided by the data strobe module.

Preferably, the driving module includes a control terminal, an input terminal, and an output terminal, wherein the control terminal of the driving module is connected to the data strobe module and the threshold compensation module, the input terminal of the driving module is connected to the threshold compensation module, and the output terminal of the driving module is connected to the light-emitting module.

Preferably, the driving module includes a second transistor, the control terminal of the driving module is a gate of the second transistor, the input terminal of the driving module is a first electrode of the second transistor, and the output terminal of the driving module is a second electrode of the second transistor.

Preferably, the data strobe module includes a first transistor, a gate of the first transistor is connected to the scanning signal line, a first electrode of the first transistor is connected to the data signal line, and a second electrode of the first transistor is connected to the control terminal of the driving module.

Preferably, the threshold compensation module includes a third transistor, a fourth transistor, and a storing capacitor, wherein a gate of the third transistor is connected to the first control signal line, a first electrode of the third transistor is connected to a second electrode of the fourth transistor, and a second electrode of the third transistor is connected to one terminal of the storing capacitor and the control terminal of the driving module;

a gate of the fourth transistor is connected to the second control signal line, a first electrode of the fourth transistor is connected to the first voltage terminal, and the second electrode of the fourth transistor is further connected to the input terminal of the driving module; and the one terminal of the storing capacitor is connected to the second electrode of the third transistor and the control terminal of the driving module, and the other terminal of the storing capacitor is connected to the output terminal of the driving module.

Wherein, the first to fourth transistors in the OLED pixel circuit are N-type transistors, P-type transistors, or a collection of transistors consisting of N-type transistors and P-type transistors.

Preferably, the light emitting module includes an OLED, an anode of the OLED is connected to the output terminal of the driving module, and a cathode of the OLED is connected to a second voltage terminal which is a low voltage terminal.

A display device including the OLED pixel circuit as described above.

A driving method of the above OLED pixel circuit, including the following steps:

a precharging step: inputting an initialization signal so as to precharge the threshold compensation module and initialize the driving module;

a reset step: inputting a reset signal, so as to reset the driving module and the light-emitting module;

a threshold voltage acquisition step: inputting a threshold voltage acquisition signal, so as to acquire a threshold voltage of the driving module;

a data writing step: inputting a scanning signal by the scanning signal line, superposing a data signal input by the data signal line on the threshold voltage, and writing the superposed data signal into the control terminal of the driving module; and a display and light-emitting step: inputting a light-emitting control signal by the second control signal line, so that the driving module drives the light-emitting module to emit light.

Preferably, in the driving method, in the precharging step, inputting the initialization signal by the first control signal line and the second control signal line, so that the third transistor and the fourth transistor are turned on, so as to input a high level at the first voltage terminal to the gate of the second transistor, and precharge the storing capacitor;

in the reset step, inputting the reset signal by the second control signal line, so that the third transistor is turned off, the second transistor and the fourth transistor are turned on, so as to reset the second electrode of the second transistor and the anode of the OLED by a low level at the first voltage terminal;

in the threshold voltage acquisition step, inputting the threshold voltage acquisition signal by the first control signal line, so that the fourth transistor is turned off, the second transistor and the third transistor are turned on, and a difference between a voltage at the gate of the second transistor and a voltage at the second electrode of the second transistor is a threshold voltage of the second transistor, the threshold voltage being stored into the storing capacitor so as to be used for compensating a threshold voltage of the second transistor;

in the data writing step, inputting the scanning signal by the scanning signal line, so that the first transistor is turned on, the third transistor and the fourth transistor are turned off, so as to superpose the data signal input by the data signal line on the threshold voltage stored in the storing capacitor, and write the superposed data signal into the gate of the second transistor; and in the display and light-emitting step, inputting the light-emitting control signal by the second control signal line, so that the first transistor and the third transistor are turned off, the second transistor and the fourth transistor are turned on, the high level at the first voltage terminal is input to the first electrode of the second transistor, and the second electrode of the second transistor drives the light-emitting module to emit light, thereby achieving display.

REFERENCE NUMERALS

1—data strobe module;
2—threshold compensation module;
3—driving module; and
4—light-emitting module.

DETAILED DESCRIPTION OF THE EMBODIMENTS

For better understanding the technical solutions of the present invention by a person skilled in the art, an OLED pixel circuit, a driving method of the same, and a display device according to the present invention will be described in detail with reference to the drawings and the following embodiments.

An OLED pixel circuit is provided according to one aspect of the present invention.

Figure 1:
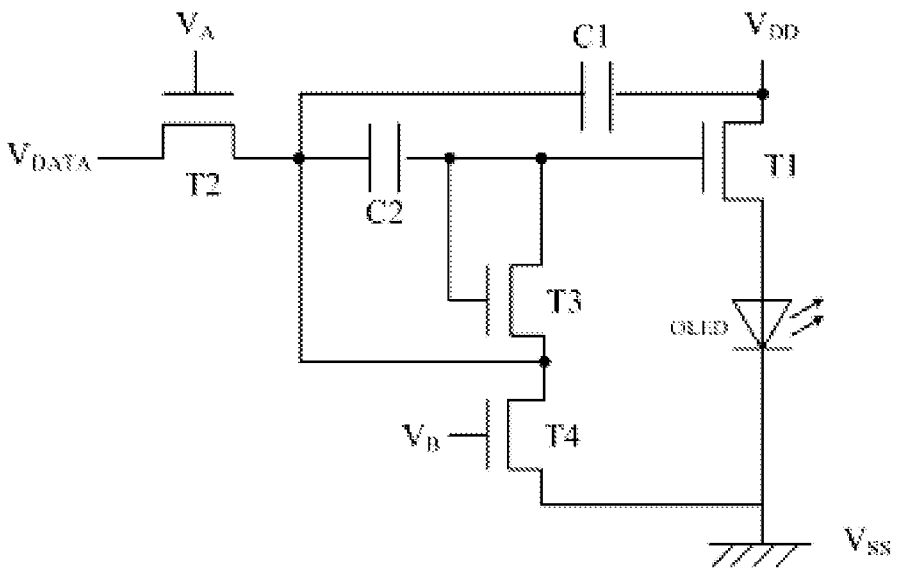
FIG. 1 is a schematic diagram showing a structure of an OLED pixel circuit in the prior art.
Figure 2:
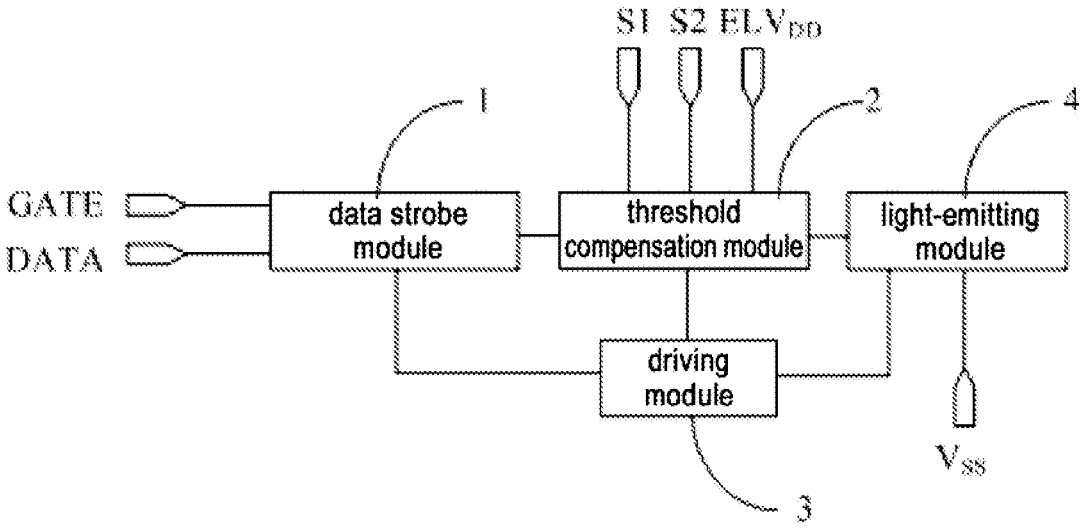
FIG. 2 is a block diagram showing a structure of an OLED pixel circuit according to an embodiment of the present invention.

FIG. 2 is a block diagram showing a structure of the OLED pixel circuit according to an embodiment of the present invention. As shown in FIG. 2, the OLED pixel circuit includes a data strobe module 1, a threshold compensation module 2, a driving module 3, and a light-emitting module 4, wherein, the data strobe module 1 is connected to the driving module 3, a scanning signal line GATE, and a data signal line DATA, respectively, and is used for inputting a data signal on the data signal line DATA to the driving module 3 under control of a scanning signal of the scanning signal line GATE;

the threshold compensation module 2 is connected to the data strobe module 1, a first control signal line S1, a second control signal line S2, a first voltage terminal $ELV_{DD}$, and the driving module 3, respectively, and is used for compensating a threshold voltage of the driving module 3 according to control signals of the first control signal line S1 and the second control signal line S2; and the driving module 3 is further connected to the light-emitting module 4, and is used for driving the light-emitting module 4 to emit light according to the data signal provided by the data strobe module 1.

Wherein, the driving module 3 includes a control terminal, an input terminal, and an output terminal. The control terminal of the driving module 3 is connected to the data strobe module 1 and the threshold compensation module 2. The input terminal of the driving module 3 is connected to the threshold compensation module 2, and the output terminal of the driving module 3 is connected to the light-emitting module 4.

Figure 3:
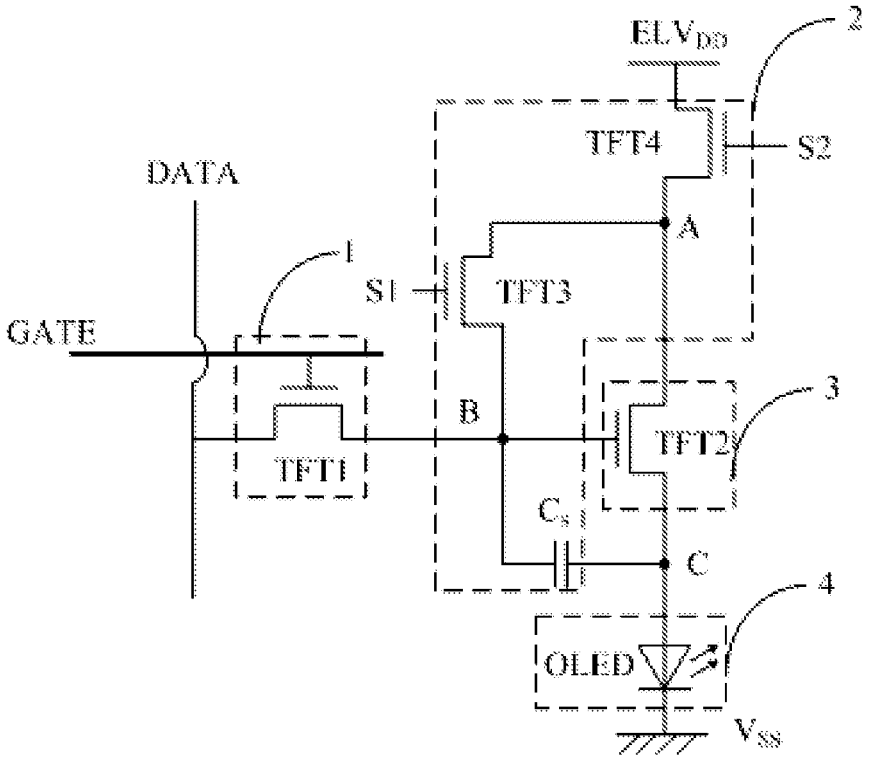
FIG. 3 is a structural schematic diagram corresponding to the block diagram showing the structure of the OLED pixel circuit shown in FIG. 2.

Specifically, as shown in FIG. 3, the driving module 3 includes a second transistor TFT2. The control terminal of the driving module 3 is a gate of the second transistor TFT2. The input terminal of the driving module 3 is a first electrode of the second transistor TFT2, and the output terminal of the driving module 3 is a second electrode of the second transistor TFT2.

The data strobe module 1 includes a first transistor TFT1. A gate of the first transistor TFT1 is connected to the scanning signal line GATE. A first electrode of the first transistor TFT1 is connected to the data signal line DATA, and a second electrode of the first transistor TFT1 is connected to the control terminal of the driving module 3.

The threshold compensation module 2 includes a third transistor TFT3, a fourth transistor TFT4 and a storing capacitor $C_S$, wherein, the gate of the third transistor TFT3 is connected to the first control signal line S1, a first electrode of the third transistor TFT3 is connected to a second electrode of the fourth transistor TFT4, and a second electrode of the third transistor TFT3 is connected to one terminal of the storing capacitor $C_S$ and the control terminal of the driving module 3;

a gate of the fourth transistor TFT4 is connected to the second control signal line S2, a first electrode of the fourth transistor TFT4 is connected to the first voltage terminal $ELV_{DD}$, and the second electrode of the fourth transistor TFT4 is further connected to the input terminal of the driving module 3; and the one terminal of the storing capacitor $C_S$ is connected to the second electrode of the third transistor TFT3, and the other terminal of the storing capacitor $C_S$ is connected to the output terminal of the driving module 3.

Obviously, in this case, the gate of the second transistor TFT2 in the driving module 3 is connected to the second electrode of the first transistor TFT1, the second electrode of the third transistor TFT3, and the one terminal of the storing capacitor $C_S$, respectively. The first electrode of the second transistor TFT2 is connected to the second electrode of the fourth transistor TFT4. The second electrode of the second transistor TFT2 is connected to the other terminal of the storing capacitor $C_S$ and the light-emitting module 4.

The light emitting module 4 includes an OLED. An anode of the OLED is connected to the output terminal of the driving module 3, and a cathode of the OLED is connected to a second voltage terminal $V_{SS}$ which is a low voltage terminal. In the present embodiment, with reference to FIGS. 3 and 4, a data voltage $V_{DATA}$ precharges the storing capacitor $C_S$ via the first transistor TFT1 (which is equivalent to a switch transistor), to provide a gated OLED with a data signal having display information, enabling the data signal to control an electric current flowing through the OLED. Thus, the OLED can emit light and display.

In the present embodiment, description is made by taking a thin film transistor (TFT) as an example. That is, the mentioned transistors in the present embodiment are thin film transistors. Further, in the present embodiment, the OLED pixel circuit includes four thin film transistors and one storing capacitor. Wherein, TFT1 is a switch transistor, TFT2 is a driving transistor, and TFT3 and TFT4 are control transistors. S1 and S2 are control signal lines, and output control signals. GATE is a scanning signal line, and outputs a scanning signal. DATA is a data signal line, and outputs a data signal. The first voltage terminal $ELV_{DD}$ provides a power signal, and the second voltage terminal $V_{SS}$ provides a grounding signal.

In the present embodiment, all of the first transistor TFT1 to the fourth transistor TFT4 in the OLED pixel circuit are N-type transistors. In this case, the first electrode thereof may be a source, and the second electrode thereof may be a drain. Alternatively, all of the first transistor TFT1 to the fourth transistor TFT4 in the OLED pixel circuit are P-type transistors. In this case, the first electrode thereof may be a drain, and the second electrode thereof may be a source. Alternatively, the first transistor TFT1 to the fourth transistor TFT4 in the OLED pixel circuit may be mixedly selected from the N-type transistors and the P-type transistors, as long as polarities of terminals of the selected types of transistors TFT1 to TFT4 are connected according to the above-described polarities of terminals of the transistors TFT1 to TFT4 when connection is performed. At the same time, it should be understood that, TFT1 to TFT4 in the present embodiment are not limited to TFTs, any circuit having a control device with voltage control capability to make the present invention operate as the above operation mode should fall within the protection scope of the present invention. A person skilled in the art can make changes to the present invention as desired, and detailed description thereof is omitted.

Figure 4:
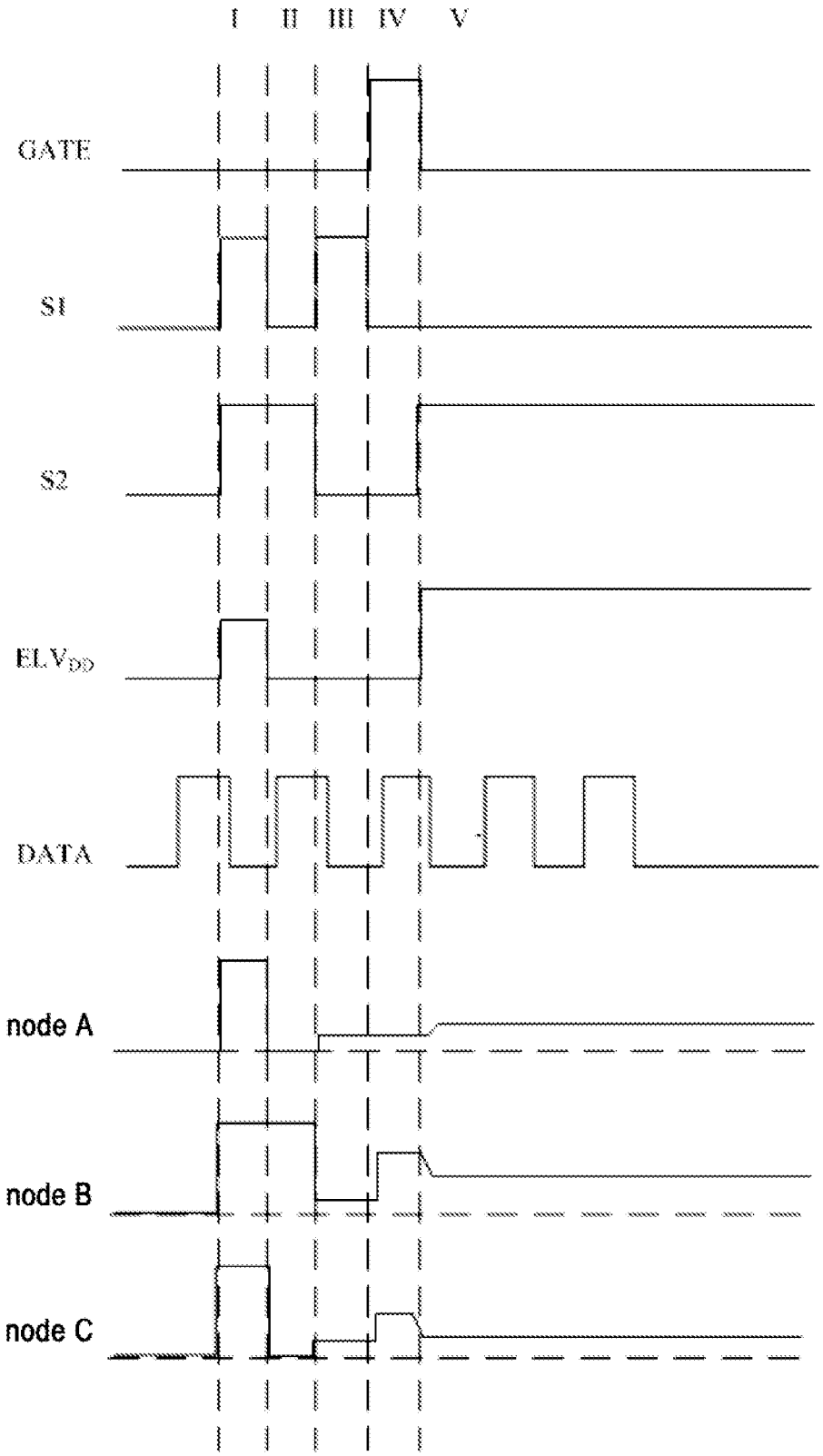
FIG. 4 is a signal sequence diagram corresponding to the structural schematic diagram of the OLED pixel circuit shown in FIG. 3.

FIG. 4 shows a signal sequence diagram of the OLED pixel circuit according to the present embodiment, including waveforms of driving signals and nodes. In the present embodiment, the first voltage terminal $ELV_{DD}$ provides a power source having a voltage range of 10-15V, and is used for driving the OLED. A setting range of the data voltage $V_{DATA}$ is determined according to driving requirements of the OLED pixel circuit in a specific application.

Further, it should be noted that, as shown in FIG. 3, the input terminal of the driving module 3 is a node A which is a connection point of the threshold compensation module 2 and the driving module 3. The control terminal of the driving module 3 is a node B which is a connection point of the data strobe module 1, the threshold compensation module 2, and the driving module 3. The output terminal of the driving module 3 is a node C which is connection point of the driving module 3 and the light-emitting module 4.

The OLED pixel circuit according to the embodiment of the present invention can achieve the technical effect of compensating shift and inconsistency of a threshold voltage, through acquiring the threshold voltage of the driving transistor in the OLED pixel circuit by the storing capacitor firstly, and then, superposing the threshold voltage on a data signal when data is written. Further, the OLED pixel circuit has high reliability due to its simple structure. Since a drive current will not be affected by the threshold voltage of the transistor, the display effect of the OLED is improved (more stable) and a service life of the OLED is extended. Thus, advantages of high precision grayscale control and high stability of the OLED pixel circuit in the prior art are maintained.

According to another aspect of the present invention, a driving method of the OLED pixel circuit is provided. In an embodiment of the present invention, the driving method of the OLED pixel circuit includes the following five steps: a precharging step, a reset step, a threshold voltage acquisition step, a data writing step, and a display and light-emitting step. Wherein, the precharging step (Step I): inputting an initialization signal so as to precharge the threshold compensation module and initialize the driving module;

the reset step (Step II): inputting a reset signal, so as to reset the driving module and the light-emitting module;

the threshold voltage acquisition step (Step III): inputting a threshold voltage acquisition signal, so as to acquire a threshold voltage of the driving module;

the data writing step (Step IV): inputting a scanning signal by the scanning signal line, superposing a data signal input by the data signal line on the threshold voltage, and writing the superposed data signal into the control terminal of the driving module; and the display and light-emitting step (Step V): inputting a light-emitting control signal by the second control signal line, so that the driving module drives the light-emitting module to emit light.

Specifically, the steps of the driving method are as follows. In the precharging step, the initialization signal is input by the first control signal line and the second control signal line, so that the third transistor and the fourth transistor are turned on, so as to input a high level at the first voltage terminal to the gate of the second transistor, and precharge the storing capacitor. Specifically, as shown in FIGS. 3 and 4, GATE is at a low level, the first transistor TFT1 is turned off. The first control signal line S1 and the second control signal line S2 are at high levels, and the third transistor TFT3 and the fourth transistor TFT4 are turned on. A signal at the first voltage terminal $ELV_{DD}$ is a high level, and the high level at $ELV_{DD}$ is input to the gate of the second transistor TFT2 to precharge the storing capacitor $C_S$, i.e., to charge the node B. TFT2 is turned on when the voltage at the node B is greater than the threshold voltage. The OLED emits light transitorily at this time. However, since the light-emitting time is very short, an influence on contrast of the pixel point is negligible.

In the reset step, the reset signal is input by the second control signal line, so that the third transistor is turned off, and the second transistor and the fourth transistor are turned on, so as to reset the second electrode of the second transistor and the anode of the OLED by a low level at the first voltage terminal. Specifically, as shown in FIGS. 3 and 4, a signal at GATE is a low level, and the first transistor TFT1 is turned off. S1 is at a low level, and the third transistor TFT3 is turned off. S2 is at a high level, and the fourth transistor TFT4 is turned on. The second transistor TFT2 keeps turned on. The first voltage terminal $ELV_{DD}$ is at a low level, and the low level at $ELV_{DD}$ resets the second electrode of the second transistor (that is, resets the output terminal of the driving terminal 3). The node C is at a low level. The anode of the OLED is reset at the same time, so that the second transistor TFT2 (i.e., the driving transistor) causes display of the OLED to be in a black state (that is, the OLED does not emit light) before the threshold voltage acquisition step and during the data writing step.

In the threshold voltage acquisition step, the threshold voltage acquisition signal is input by the first control signal line, so that the fourth transistor is turned off, the second transistor and the third transistor are turned on, and a difference between a voltage at the gate of the second transistor and a voltage at the second electrode of the second transistor is a threshold voltage of the second transistor. The threshold voltage is stored into the storing capacitor so as to be used for compensating a threshold voltage of the second transistor. Specifically, as shown in FIGS. 3 and 4, GATE and S2 are at low levels, and the first transistor TFT1 and the fourth transistor TFT4 are turned off. S1 is at a high level, and the third transistor TFT3 is turned on. The node B charges the node A by the first control signal line S1 via TFT3, and TFT2 keeps on at this time. The node A discharges to the node C, and a voltage at the node C increases gradually until the voltage at the node C satisfies $V_C=V_B-V_{TH}$, where, $V_B$ is a voltage at the node B, and $V_{TH}$ is the threshold voltage of the TFT2. At this time, the capacitor between the node B and the node C stores the voltage $V_{TH}$.

As shown in FIG. 4, in the present step, neither of the voltages at the node B and the node C is zero. However, since the node B is charged first and controls the TFT2 to turn on, and the node C has a leakage path, the voltage at the node B is greater than that at the node C, that is, the storing capacitor $C_S$ stores therein a stored voltage which is not zero. That is, a difference between the voltage at the gate of the second transistor TFT2 and the voltage at the second electrode of the second transistor TFT2 is the threshold voltage of the second transistor TFT2, and the threshold voltage is stored in the storing capacitor $C_S$.

In the data writing step, the scanning signal is input by the scanning signal line, so that the first transistor is turned on, and the third transistor and the fourth transistor are turned off, so as to superpose the data signal input by the data signal line on the threshold voltage stored in the storing capacitor, and write the superposed data signal into the gate of the second transistor. Specifically, as shown in FIGS. 3 and 4, GATE is at a high level, and the first transistor TFT1 is turned on. S1 and S2 are at low levels, and the third transistor TFT3 and the fourth transistor TFT4 are turned off. $ELV_{DD}$ is at a low level, and the data voltage $V_{DATA}$ is written into the gate of the second transistor TFT2. The voltage at the node B changes, which causes the voltage at the node C to change with the change of the voltage at the node B by the coupling function of the capacitor. The node A is in a floating state.

As shown in FIG. 4, in the present step, the difference between the voltage at the node B and the voltage at the node C is greater than zero, and includes the $V_{TH}$ and the data voltage $V_{DATA}$.

In the display and light-emitting step, the light-emitting control signal is input by the second control signal line, so that the first transistor and the third transistor are turned off, the second transistor and the fourth transistor are turned on, the high level at the first voltage terminal is input to the first electrode of the second transistor, and the second electrode of the second transistor drives the light-emitting module to emit light, thereby achieving display. Specifically, as shown in FIGS. 3 and 4, GATE and S1 are at low levels, and the first transistor TFT1 and the third transistor TFT3 are turned off. S2 is at a high level, and the fourth transistor TFT4 is turned on. The second transistor TFT2 keeps on, and the first voltage terminal $ELV_{DD}$ is at a high level. The high level of the $ELV_{DD}$ provides an electric current to the light-emitting module through the fourth transistor TFT4 and the second transistor TFT2, and drives the OLED through the second electrode of the second transistor TFT2. Thus, the OLED emits light normally, thereby achieving display.

Since the difference between the voltage at the node B and the voltage at the node C is greater than zero and includes the $V_{TH}$ at this time, the electric current provided to the OLED by TFT4 and TFT2 (i.e. an electric current flowing through the OLED) is as follows:

$$I_{OLED}=I_{TFT2}=k(V_B-V_C-V_{TH})^2=k\alpha(V_{DATA}-V_0)^2 \quad (2)$$

In the equation (2), $V_{DATA}$ is the written data voltage, $\alpha$ is a constant relevant to the storing capacitor $C_S$, k is a constant relevant to the characteristics of the driving transistor, and $V_0$ is a reference voltage provided by $ELV_{DD}$ in Step I. Here, it should be understood that, as shown in FIG. 4, the first voltage terminal $ELV_{DD}$ is at a high level only in the precharging step (Step I) and the display and light-emitting step (Step V), and magnitudes of the levels therein are not equal to each other. Wherein, in Step I, the voltage of $ELV_{DD}$ ranges from 1 to 3V and used as the reference voltage provided to the gate of the second transistor TFT2; in Step V, the voltage of $ELV_{DD}$ ranges from 10 to 15V and used as a power signal which is used for driving the OLED.

In the equation (2), after a driving transistor is given, since $ELV_{DD}$ has a given supply voltage value, a value of the electric current flowing through the OLED is affected only by the data voltage $V_{DATA}$ and a capacitance of the storing capacitor $C_S$, regardless of the threshold voltage of the TFT in the driving circuit. The electric current flowing through the OLED will not be affected even if the threshold voltage $V_{TH}$ of the TFT in the driving circuit is changed or the threshold voltage $V_{TH}$ shifts. Thus, the influence on the electric current flowing through the OLED by the threshold voltage $V_{TH}$ is eliminated. Therefore, inconsistency or shift of the threshold voltage of the TFT in the OLED pixel circuit is compensated, thus the problem caused by the inconsistency or the shift of the threshold voltage is eliminated, thereby increasing the stability of the OLED pixel circuit. Further, since a voltage signal is used for driving, the storing capacitor $C_S$ in the OLED pixel circuit has a fast charging speed and a fast discharging speed. Thus, requirements of display of large area and high resolution can be met.

In addition, as shown in FIG. 4, the signals at DATA includes a plurality of data signals represented by high levels, and the plurality of data signals are sequentially written into a plurality of OLED pixel circuits strobed by the scanning signal line row by row. Corresponding to the signal at GATE in Step IV as shown in FIG. 4, the signal at DATA is the third high level. The signal at DATA is slightly delayed from the signal at GATE, preventing an error from occurring when data is written. Wherein, the data signal before the signal at GATE is turned off is a data written timely, and the data signal after the signal at GATE is turned off is maintained by the storing capacitor $C_S$ until display of a frame of picture is completed.

Here, it should be noted that, the driving circuit according the embodiment of the present invention excluding the light-emitting module is applicable not only to the OLED pixel circuit in the present embodiment, but also for driving other circuits in which it is required to eliminate the influence by the threshold voltage of the TFT in the driving circuit. That is, according to requirements of different applications, the driving circuit according to the embodiment of the present invention can be applied directly; alternatively, changes can be made (for example, a certain module in the driving circuit according to the embodiment of the present invention is replaced with another equivalent structure which can achieve the same effect) based on the driving circuit according to the embodiment of the present invention. Then, an input data voltage signal is input to the driving circuit according to the embodiment of the present invention or any equivalent thereof, to convert the input data voltage signal into a driving signal as desired.

The driving method of the OLED pixel circuit according to the embodiments of the present invention can achieve the technical effect of compensating shift and inconsistency of the threshold voltage of the driving transistor in the OLED pixel circuit, through acquiring the threshold voltage by the storing capacitor firstly, and then, superposing the threshold voltage on the data signal when data is written. Further, the OLED pixel circuit has high reliability due to its simple structure. Since a drive current will not affected by the threshold voltage of the transistor, the display effect of the OLED is improved (more stable) and a service life of the OLED is extended. Thus, advantages of high precision grayscale control and high stability of the OLED pixel circuit in the prior art are maintained.

According to still another aspect of the invention, a display device is provided. In an embodiment of the present invention, the display device includes a plurality of the above-described OLED pixel circuits. An OLED display array is formed by arranging a plurality of same OLED pixel circuits as shown in FIG. 3 in a matrix, and light emitting and display of the OLED display array can be achieve by controlling the driving circuits in the OLED pixel circuits.

The display device may be any product or component having a display function, such as electronic paper, a mobile phone, a tablet computer, a television set, a display, a laptop computer, a digital photo frame, a navigator, and the like.

Since the OLED pixel circuit according to the embodiment of the present invention is employed and has better stability, uniformity of brightness of light emitted by the OLED pixel circuits is ensured. Thus, the display quality of the display device is improved accordingly. Therefore, a flat display device having high stability and low cost can be manufactured easily, and is more suitable for mass production.

In summary, the present invention provides an OLED pixel circuit, of which a drive current is not affected by the threshold voltage of the transistor therein. That is, shift and inconsistency of a threshold voltage of the transistor in the OLED pixel circuit can be compensated, so that the drive current is not affected by the threshold voltage of the transistor. Thus, the display effect of the OLED is improved (more stable) and a service life of the OLED is extended. Further, the OLED pixel circuit has high reliability due to its simple structure, and advantages of high precision grayscale control and high stability of the OLED pixel circuit in the prior art are maintained. Therefore, the display device including the OLED pixel circuit has more uniform brightness and lower cost, and is more suitable for mass production.

It should be understood that, the above embodiments are only exemplary embodiments for the purpose of explaining the principle of the present invention, and the present invention is not limited thereto. For a person having ordinary skill in the art, various improvements and modifications may be applied to the present invention without departing from the spirit and essence of the present invention. These improvements and modifications also fall within the protection scope of the present invention.

What is claimed is:

1. An OLED pixel circuit including a data strobe module, a threshold compensation module, a driving module, and a light-emitting module, wherein the data strobe module is directly connected to the driving module, a scanning signal line, and a data signal line, respectively, and is used for inputting a data signal on the data signal line to the driving module under control of a scanning signal of the scanning signal line;

the threshold compensation module is connected to the data strobe module, a first control signal line, a second control signal line, a first voltage terminal, and the driving module, respectively, and is used for compensating a threshold voltage of the driving module according to control signals of the first control signal line and the second control signal line; and the driving module is further connected to the light-emitting module, and is used for driving the light-emitting module to emit light according to the data signal provided by the data strobe module.

2. The OLED pixel circuit according to claim 1, wherein the driving module includes a control terminal, an input terminal, and an output terminal, wherein the control terminal of the driving module is connected to the data strobe module and the threshold compensation module, the input terminal of the driving module is connected to the threshold compensation module, and the output terminal of the driving module is connected to the light-emitting module.

3. The OLED pixel circuit according to claim 2, wherein, the driving module includes a second transistor, the control terminal of the driving module is a gate of the second transistor, the input terminal of the driving module is a first electrode of the second transistor, and the output terminal of the driving module is a second electrode of the second transistor.

4. The OLED pixel circuit according to claim 2, wherein, the data strobe module includes a first transistor, a gate of the first transistor is connected to the scanning signal line, a first electrode of the first transistor is connected to the data signal line, and a second electrode of the first transistor is connected to the control terminal of the driving module.

5. The OLED pixel circuit according to claim 2, wherein, the threshold compensation module includes a third transistor, a fourth transistor, and a storing capacitor, wherein a gate of the third transistor is connected to the first control signal line, a first electrode of the third transistor is connected to a second electrode of the fourth transistor, and a second electrode of the third transistor is connected to one terminal of the storing capacitor and the control terminal of the driving module;

a gate of the fourth transistor is connected to the second control signal line, a first electrode of the fourth transistor is connected to the first voltage terminal, and the second electrode of the fourth transistor is further connected to the input terminal of the driving module; and the one terminal of the storing capacitor is connected to the second electrode of the third transistor and the control terminal of the driving module, and the other terminal of the storing capacitor is connected to the output terminal of the driving module.

6. The OLED pixel circuit according to claim 5, wherein, the first to fourth transistors in the OLED pixel circuit are N-type transistors, P-type transistors, or a collection of transistors consisting of N-type transistors and P-type transistors.

7. The OLED pixel circuit according to claim 6, wherein, the light emitting module includes an OLED, an anode of the OLED is connected to the output terminal of the driving module, and a cathode of the OLED is connected to a second voltage terminal which is a low voltage terminal.

8. A driving method of the OLED pixel circuit according to claim 7, including the following steps:

a precharging step: inputting an initialization signal so as to precharge the threshold compensation module and initialize the driving module;

a reset step: inputting a reset signal, so as to reset the driving module and the light-emitting module;

a threshold voltage acquisition step: inputting a threshold voltage acquisition signal, so as to acquire a threshold voltage of the driving module;

a data writing step: inputting a scanning signal by the scanning signal line, superposing a data signal input by the data signal line on the threshold voltage, and writing the superposed data signal into the control terminal of the driving module; and a display and light-emitting step: inputting a light-emitting control signal by the second control signal line, so that the driving module drives the light-emitting module to emit light.

9. The driving method according to claim 8, wherein in the precharging step, inputting the initialization signal by the first control signal line and the second control signal line, so that the third transistor and the fourth transistor are turned on, so as to input a high level at the first voltage terminal to the gate of the second transistor, and precharge the storing capacitor;

in the reset step, inputting the reset signal by the second control signal line, so that the third transistor is turned off, the second transistor and the fourth transistor are turned on, so as to reset the second electrode of the second transistor and the anode of the OLED by a low level at the first voltage terminal;

in the threshold voltage acquisition step, inputting the threshold voltage acquisition signal by the first control signal line, so that the fourth transistor is turned off, the second transistor and the third transistor are turned on, and a difference between a voltage at the gate of the second transistor and a voltage at the second electrode of the second transistor is a threshold voltage of the second transistor, the threshold voltage being stored into the storing capacitor so as to be used for compensating a threshold voltage of the second transistor;

in the data writing step, inputting the scanning signal by the scanning signal line, so that the first transistor is turned on, the third transistor and the fourth transistor are turned off, so as to superpose the data signal input by the data signal line on the threshold voltage stored in the storing capacitor, and write the superposed data signal into the gate of the second transistor; and in the display and light-emitting step, inputting the light-emitting control signal by the second control signal line, so that the first transistor and the third transistor are turned off, the second transistor and the fourth transistor are turned on, the high level at the first voltage terminal is input to the first electrode of the second transistor, and the second electrode of the second transistor drives the light-emitting module to emit light, thereby achieving display.

10. A display device including an OLED pixel circuit, the OLED pixel circuit including a data strobe module, a threshold compensation module, a driving module, and a light-emitting module, wherein the data strobe module is directly connected to the driving module, a scanning signal line, and a data signal line, respectively, and is used for inputting a data signal on the data signal line to the driving module under control of a scanning signal of the scanning signal line;

the threshold compensation module is connected to the data strobe module, a first control signal line, a second control signal line, a first voltage terminal, and the driving module, respectively, and is used for compensating a threshold voltage of the driving module according to control signals of the first control signal line and the second control signal line; and the driving module is further connected to the light-emitting module, and is used for driving the light-emitting module to emit light according to the data signal provided by the data strobe module.

11. The display device according to claim 10, wherein the driving module includes a control terminal, an input terminal, and an output terminal, wherein the control terminal of the driving module is connected to the data strobe module and the threshold compensation module, the input terminal of the driving module is connected to the threshold compensation module, and the output terminal of the driving module is connected to the light-emitting module.

12. The display device according to claim 11, wherein, the driving module includes a second transistor, the control terminal of the driving module is a gate of the second transistor, the input terminal of the driving module is a first electrode of the second transistor, and the output terminal of the driving module is a second electrode of the second transistor.

13. The display device according to claim 11, wherein, the data strobe module includes a first transistor, a gate of the first transistor is connected to the scanning signal line, a first electrode of the first transistor is connected to the data signal line, and a second electrode of the first transistor is connected to the control terminal of the driving module.

14. The display device according to claim 11, wherein, the threshold compensation module includes a third transistor, a fourth transistor, and a storing capacitor, wherein a gate of the third transistor is connected to the first control signal line, a first electrode of the third transistor is connected to a second electrode of the fourth transistor, and a second electrode of the third transistor is connected to one terminal of the storing capacitor and the control terminal of the driving module;

a gate of the fourth transistor is connected to the second control signal line, a first electrode of the fourth transistor is connected to the first voltage terminal, and the second electrode of the fourth transistor is further connected to the input terminal of the driving module; and the one terminal of the storing capacitor is connected to the second electrode of the third transistor and the control terminal of the driving module, and the other terminal of the storing capacitor is connected to the output terminal of the driving module.

15. The display device according to claim 14, wherein, the first to fourth transistors in the OLED pixel circuit are N-type transistors, P-type transistors, or a collection of transistors consisting of N-type transistors and P-type transistors.

16. The display device according to claim 15, wherein, the light emitting module includes an OLED, an anode of the OLED is connected to the output terminal of the driving module, and a cathode of the OLED is connected to a second voltage terminal which is a low voltage terminal.

* * * * *